US006373356B1

(12) United States Patent
Gutierrez et al.

(10) Patent No.: US 6,373,356 B1
(45) Date of Patent: Apr. 16, 2002

(54) MICROELECTROMECHANICAL LIQUID METAL CURRENT CARRYING SYSTEM, APPARATUS AND METHOD

(75) Inventors: Adolfo O. Gutierrez, Troy; Steven C. Aceto, Wynantskill; James T. Woo, North Greenbush, all of NY (US); Christopher Cormeau, Moorpark, CA (US)

(73) Assignee: InterScience, Inc., Troy, NY (US)

( * ) Notice: Subject to any disclaimer, the term of this patent is extended or adjusted under 35 U.S.C. 154(b) by 0 days.

(21) Appl. No.: 09/575,352

(22) Filed: May 19, 2000

Related U.S. Application Data

(60) Provisional application No. 60/135,449, filed on May 21, 1999.

(51) Int. Cl.[7] ..... H01H 29/00
(52) U.S. Cl. ..... 335/47; 200/233
(58) Field of Search ..... 335/47–48, 49–58; 200/233–5, 192–3

(56) References Cited

U.S. PATENT DOCUMENTS

| | | | | |
|---|---|---|---|---|
| 3,144,533 A | * | 8/1964 | Donath | 335/47 |
| 3,592,990 A | * | 7/1971 | Lucas et al. | 200/152 |
| 3,753,175 A | * | 8/1973 | Gillette et al. | 335/47 |
| 4,510,356 A | | 4/1985 | Malm | |
| 4,841,834 A | | 6/1989 | Gruden | |
| 5,398,011 A | | 3/1995 | Kimura et al. | |
| 5,578,976 A | * | 11/1996 | Yao | 333/262 |
| 5,778,513 A | | 7/1998 | Miu et al. | |
| 5,847,631 A | | 12/1998 | Taylor et al. | |
| 5,889,452 A | | 3/1999 | Vuilleumier | |
| 5,912,606 A | * | 6/1999 | Nathanson et al. | 335/47 |
| 5,959,338 A | | 9/1999 | Younger et al. | |
| 6,025,767 A | | 2/2000 | Kellam et al. | |
| 6,126,140 A | | 10/2000 | Johnson et al. | |

OTHER PUBLICATIONS

Hosaka, Kuwano, & Yanagisawa. Electromagnetic microrelays: concepts and fundamental characteristics. Sensors and Actuators A, 40, 1994, 41–47, (No date).

Saffer, Simon, Kim, Park & Lee. Mercury–contact Switching with Gap–Closure Microcantilever. SPIE vol. 2882, 1996, 204–209, (No Month).

Simon, Saffer, Sherman, & Kim. Lateral Polysilicon Microrelays with a Mercury Microdrip Contact. IEEE Transactions on Industrial Electronics, vol. 45, No. 6, Dec. 1998, 854–860.

Kim. Microgasketing and Adhesive Wicking Techniques for Fabrication of Microfludic Devices. SPIE vol. 3515, Sep. 1998, 286–291.

* cited by examiner

*Primary Examiner*—Lincoln Donovan
(74) *Attorney, Agent, or Firm*—Jay R. Yablon; Michelle D. Simkulet

(57) ABSTRACT

A microelectromechanical power relay uses mercury, or a similar liquid metal with high surface tension, as a flexible non-degrading contact mechanism. The basic systematic requirements for the micro-relay include large current carrying capacity, high speed, use of control voltages readily available in the given application, and an acceptable hold-off voltage. The preferred embodiment of the present invention includes the novel configuration of a liquid metal current carrying switching device.

14 Claims, 5 Drawing Sheets

MICROELECTROMECHANICAL LIQUID METAL CURRENT CARRYING SYSTEM, APPARATUS AND METHOD

CROSS-REFERENCE TO RELATED APPLICATIONS

This application claims the benefit of U.S. Provisional Application No. 60/135,449, filed May 21, 1999.

FIELD OF THE INVENTION

This invention relates to the field of microelectromechanical systems (MEMS) current carrying devices and power relays, and particularly to microelectromechanical current carrying devices and power relays with liquid metal contacts, such as mercury.

BACKGROUND OF THE INVENTION

Electrical relays are extensively used in low voltage electric power distribution systems. As aircraft designs shift towards flight-by-wire and flight-by-light concepts, distributed power bus architectures are increasingly being adopted in newer aircraft and spacecraft. Under distributed power bus architecture, electric relays are replacing mechanical and pneumatic actuators, as the key components for power and signal distribution. Specifically in aerospace applications where radiation hardness (rad-hard) is an important consideration, MEMS based power relays offer significant advantages over solid state devices based on semiconductor p-n junctions. In general, power relays must have high current carrying capacity, low contact series impedance, fast switching operation, acceptable hold-off voltage, and they require sufficiently low control voltage.

Two of the main factors limiting the performance of MEMS based micro-relay devices have resulted from the use of high resistance thin metal layers to feed current to the contact region and the rapid contact degradation related to heat-enhanced electromigration. In general, devices using standard poly-silicon micromachining processes present high resistance in the metal-poly contact due to oxide buildup enhanced by local heating. An alternative approach is to use gold which has been demonstrated to perform better as a contact material since it does not oxidize and only requires the application of a small closing force for attaining a reliable contact. However, gold has the tendency to self-weld and electro-migration is still a problem.

OBJECTS OF THE INVENTION

Therefore, it is desirable to provide an improved microelectromechanical power relay.

It is also desirable to provide an improved microelectromechanical power relay capable of high power operation when configured in a stacked array.

It is also desirable generally to provide a means for carrying current using a liquid metal.

SUMMARY OF THE INVENTION

A microelectromechanical current carrying apparatus as disclosed herein comprises a microcavity chamber and a liquid metal filling the microcavity chamber. A voltage differential is applied between the liquid metal at lower and upper ends of this chamber, thereby causing a current to be carried by the liquid metal. In a preferred embodiment, lower and upper contacts contact the liquid metal at these lower and upper chamber ends for purpose of applying this voltage differential. To use this apparatus as a relay/switch, the upper contact is moved to establish and break the contact with the liquid metal at the upper end of the chamber to respectively initiate and terminate the current carriage between the lower and upper contacts. By having the upper contact reside in a default position where it is not in contact with the liquid metal, a control electrode may be activated to draw the upper contact away from its default position, toward the control electrode, and into contact with said liquid metal to initiate the current flow, and may further be deactivated to cease drawing the upper contact toward the control electrode, break the contact of the upper contact with the liquid metal to terminate the current flow, and allow the upper contact to return to its default position.

The present invention provides for a metal-mercury contact micro-relay based on silicon micromachining technology. When arranged in a parallel array of vertical micro-relays, the system is capable of switching currents on the order of 1 ampere per device array. Micromachined micro-relays can also function as mechanical switches, because they rely on majority carriers conduction and do not have any functional semiconductor junctions. They are inherently rad-hard devices suitable for use in space as a replacement for solid state devices and in other high radiation environment such as those found in the nuclear industry. Rapid switching of large current is a problem with solid contact based relays because of arcing when current flow is disrupted, causing damage to the contacts and degrading their conductivity due to pitting of the electrode surfaces. The liquid metal based MEMS relay eliminates the problem first by distributing the current between many relays in parallel to reduce the voltage on a single relay, and secondly because the contacts are liquid, they are self-healing.

BRIEF DESCRIPTION OF THE DRAWINGS

The features of the invention believed to be novel are set forth in the associated claims. The invention, however, together with further objects and advantages thereof, may best be understood by reference to the following description taken in conjunction with the accompanying drawings in which:

DETAILED DESCRIPTION

Figure 1:
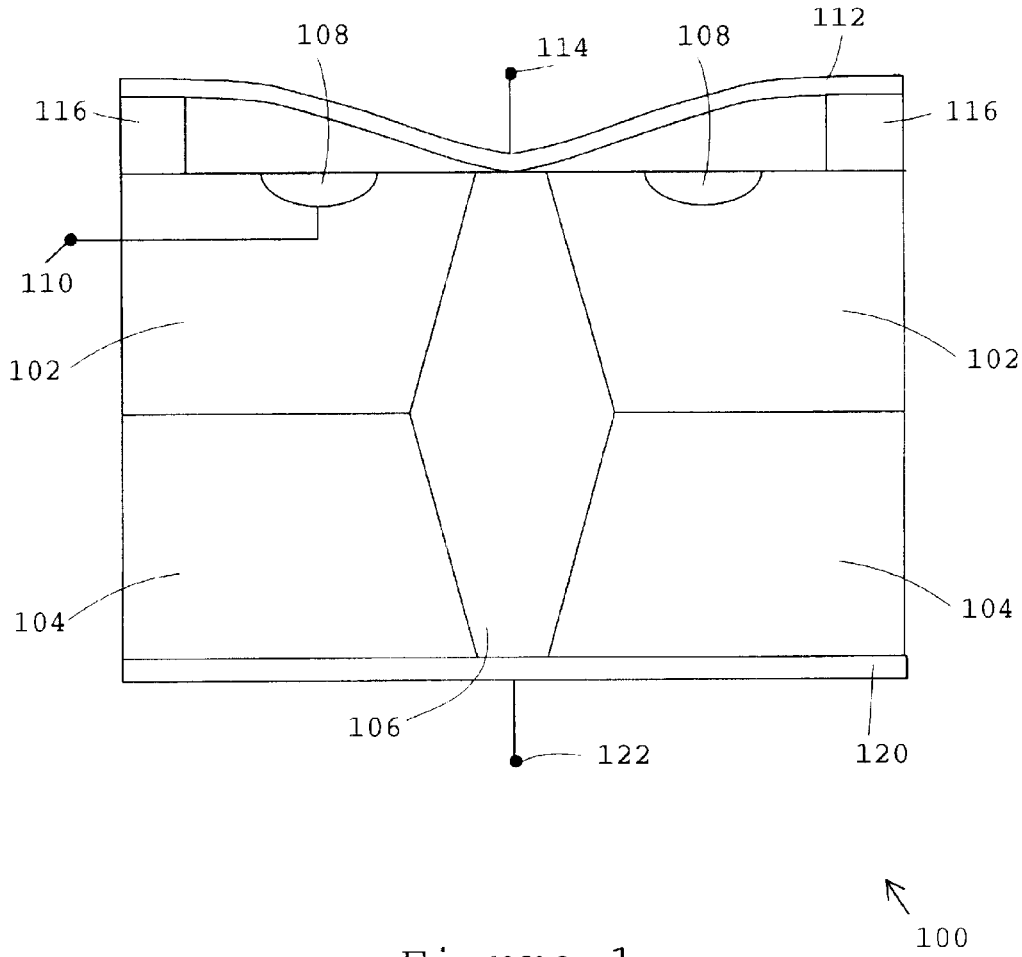
FIG. 1 is a cross-sectional view of a preferred embodiment of a microelectromechanical relay, in the "on" position.
Figure 2:
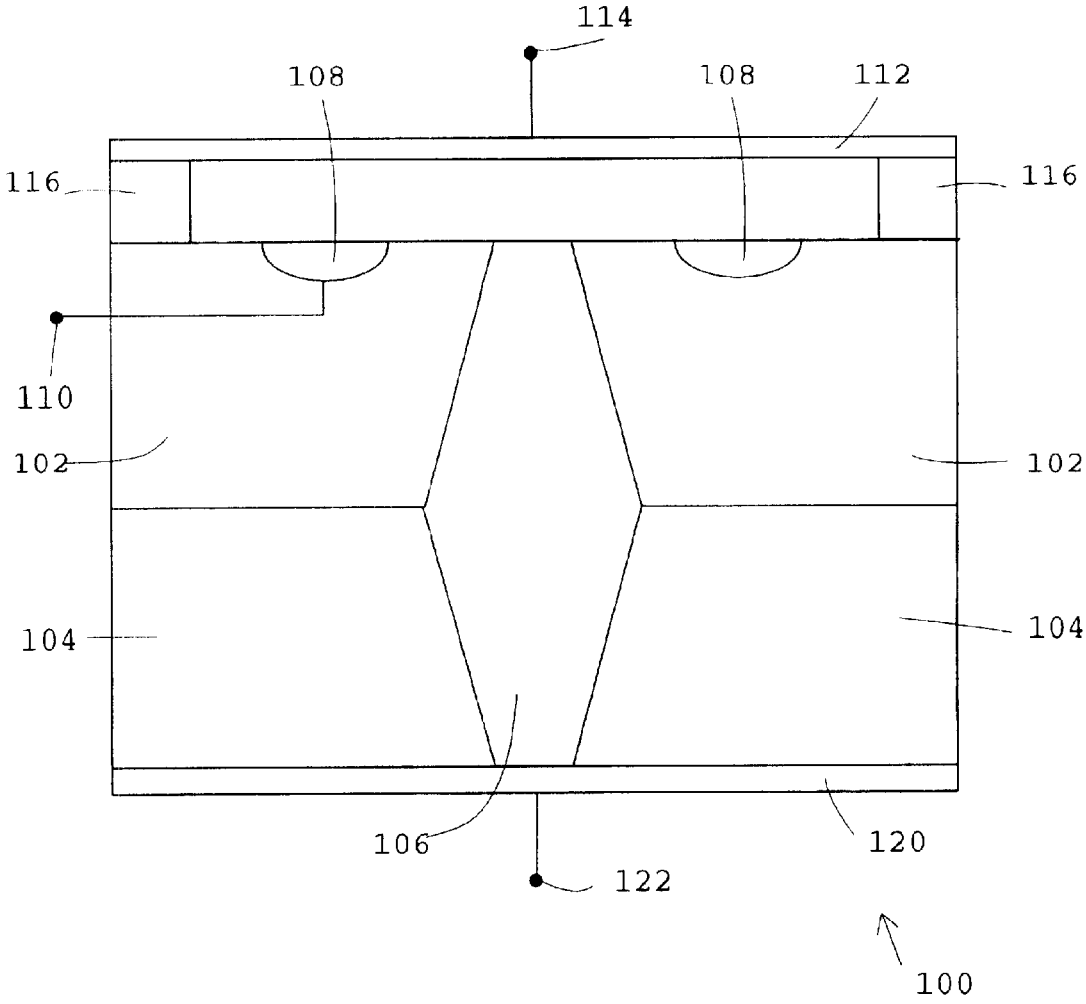
FIG. 2 is a cross-sectional view of this microelectromechanical relay in the "off" position.
Figure 3:
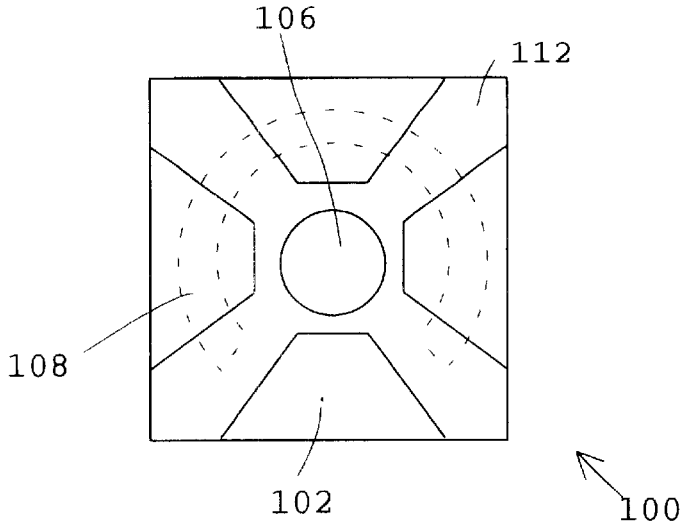
FIG. 3 is a top view of this microelectromechanical relay.

A preferred embodiment of the invention is described in detail with reference to FIGS. 1, 2, and 3. FIG. 1 shows the microelectromechanical power relay 100 in the "on" position and FIG. 2 shows the microelectromechanical power relay 100 in the "off" position. FIG. 3 is a top view of the relay showing the position and orientation of the components.

This preferred embodiment comprises an upper wafer 102 and a lower wafer 104, both typically made of silicon, bonded back to back. A microcavity chamber 106 is anisotropically etched through the center of the wafers (upper and lower) 102 and 104, prior to bonding. In general, the upper wafer 102 and lower wafer 104, and thus the walls of the microcavity chamber 106, are required to be made of a dielectric material, or even more generally, a material demonstrating a higher insulating capacity than that of the liquid metal filling the microcavity chamber 106. The microcavity chamber 106 is filled with a liquid metal, typically mercury, which will remain confined within the microcavity chamber 106 as a result of the very strong surface tension forces of liquid mercury—about 10 times that of water—and the large volume to surface of the elongated microdroplet of mercury. This liquid metal such as mercury is micro-encapsulated between two contacts, namely upper contact 112 and lower contact 120.

A microcavity chamber 106 filled with a liquid metal as shown has a broad range of application. Because it provides a means of electrically shorting a two-sided device, or more specifically a two-sided micro-machined device, it can be generally applied to many microelectromechanical devices. The provision for metal/liquid metal contacts in a MEMS device, eliminates problems inherent in MEMS solid contact switches, such as electrode pitting which can cause arcing. The liquid metal contact is also self-healing and thus does not suffer the problems associated with pitted electrodes.

A control electrode 108 is implanted or deposited near the top surface of upper wafer 102 during the fabrication process. Control electrode 108 partially encircles the access to the microcavity chamber 106 in the upper wafer 102. A control electrode source 110 provides any necessary electrical connection to control electrode 108. Upper contact 112 and upper contact source 114 are supported above the upper wafer 102 access to the microcavity chamber 106 by a contact support 116. In addition, a lower contact 120 and associated lower contact source 122 are bonded to the bottom side of the lower wafer 104 and seal the lower access to the microcavity chamber 106.

In this preferred embodiment, both the upper contact 112 and lower contact 120 are made of metal. Alternatively, the contacts can be made of doped poly-silicon. If doped poly-silicon is used, a low resistance path must be provided through heavy doping or via hole metallizations. If poly-silicon is used instead of metal, field rings can be inserted in the upper contact 112 for better controlling breakdown. Similarly, in this preferred embodiment, the first contact support 116 is typically made of silicon dioxide.

Operationally, the microelectromechanical power relay 100 is shown in the "on" position in FIG. 1 and in the "off" position in FIG. 2. The operation of the power relay 100 relies on current flow through the mercury filled microcavity chamber 106. The on position is preferably achieved through electrostatic attraction between upper contact 112 and control electrode 108, thereby providing electrical contact between the upper contact 112 and the mercury in the microcavity chamber 106, which completes the circuit for current flow. The geometry of power relay 100 provides for the area of maximized bending of upper contact 112 to align with the upper access of the mercury filled microcavity chamber 106, as shown in FIG. 1. Lower contact 120 is the electrical contact on the back side of the power relay 100. As shown in FIG. 2, no current flows through power relay 100, when it is in the "loff" position. Applied voltage is removed from the control electrode 108, thereby removing any electrostatic attraction, and upper contact 112 resumes its default or normal position thereby eliminating contact between upper contact 112 and the liquid metal, e.g., mercury in the microcavity chamber 106. Switching action, between the "on" and "off" states, is achieved through electrostatic attraction by cyclically applying and removing voltage to control electrode 108.

The current flow in power relay 100 is axially symmetric thus preventing crowding and local overheating. The mercury-metal interfaces, between the upper and lower contacts 112 and 120 and the mercury in the microcavity chamber 106, provide a low resistance contact that presents minimal degradation for high current densities and enables large number of cycles. The voltage gap is defined as the linear distance between the upper contact 112 and the control electrode 108. This gap is chosen wide enough to provide good hold-off voltage and narrow enough to minimize actuation voltage requirement and switching delays. The flexibility of the upper contact 112, which is a function of the material used, thickness, and geometric configuration, plays an important role in determining the gap.

Figure 4:
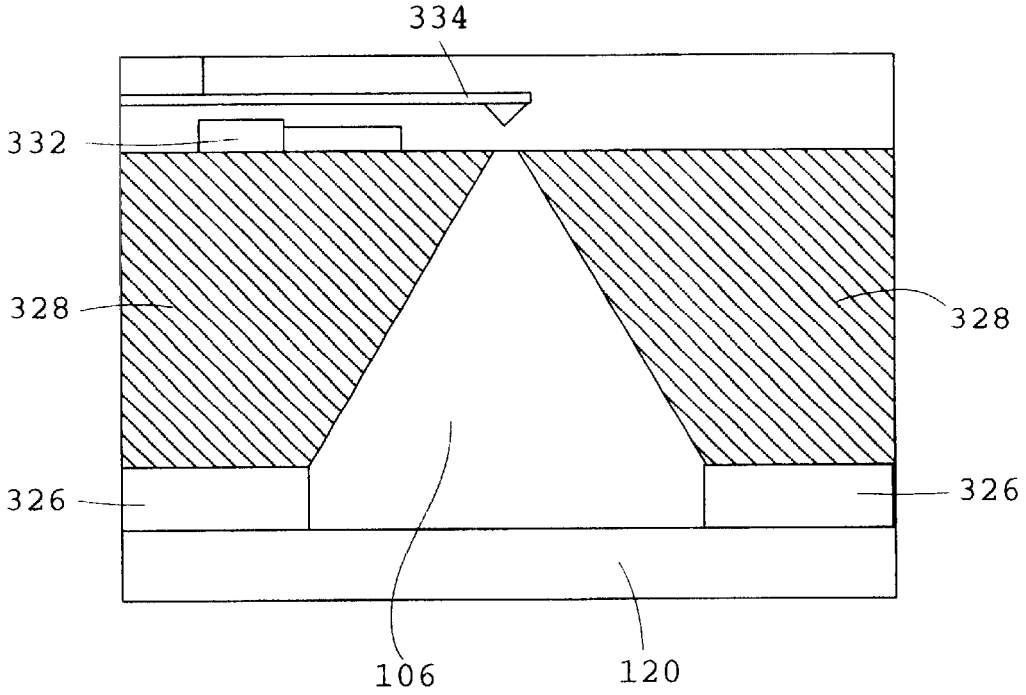
FIG. 4 is a cross-sectional view of an alternative preferred embodiment of the invention.

An alternative preferred embodiment of the invention is presented in FIG. 4. This alternative embodiment provides a simplified alternative for encapsulating the micro-volume of mercury. The alternative design comprises lower contact 120, a well plate 326 with an etched hole, a cover plate 328 with a tapered hole, liquid metal, e.g., mercury filled microcavity chamber 106, a control electrode 108 comprising secondary electrode 332 and an upper contact 112 comprising actuation structure 334. As shown in FIG. 4, the holes in cover plate 328 and well plate 326 define the boundaries for mercury microcavity chamber 106, which is sealed by lower contact 120.

On the side of the mercury microcavity chamber 106 with the small end of the tapered hole and exposed meniscus of mercury, opposite the conducting base plate 324, is the secondary electrode 332 and actuation structure 334. Voltage applied to secondary electrode 332 attracts actuation structure 334 and initiates contact between actuation structure 334 and the mercury in the microcavity chamber 106, and thus current flow. The operational design of this alternative embodiment is the same as the preferred embodiment, it just provides a simplified structural alternative.

Mercury microcavity chamber 106 can be filled with mercury by a variety of means. In one approach, the tapered side walls of the etched hole in cover plates 328 (and of upper wafer 102 and/or lower wafer 104 in FIG. 1) are lined with a deposition of gold or a similar deposition metal which has a high affinity with mercury or whatever similar liquid metal is being employed in microcavity chamber 106, in order to allow the chemical vapor deposition (CVD) of mercury into microcavity chamber 106.

Figure 5:
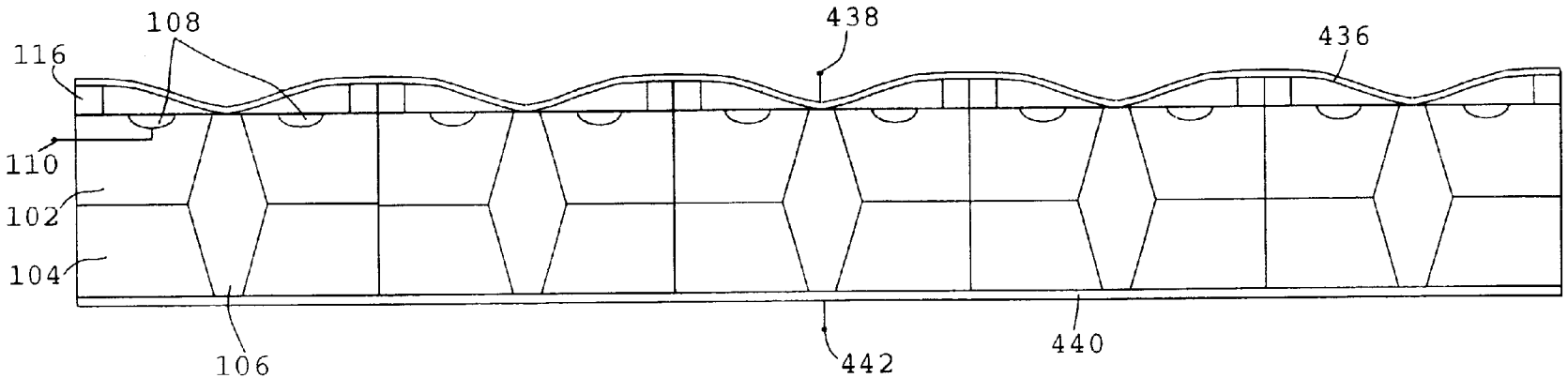
FIG. 5 is a cross-sectional view of a horizontal array of microelectromechanical relays in the "on" position.
Figure 6:
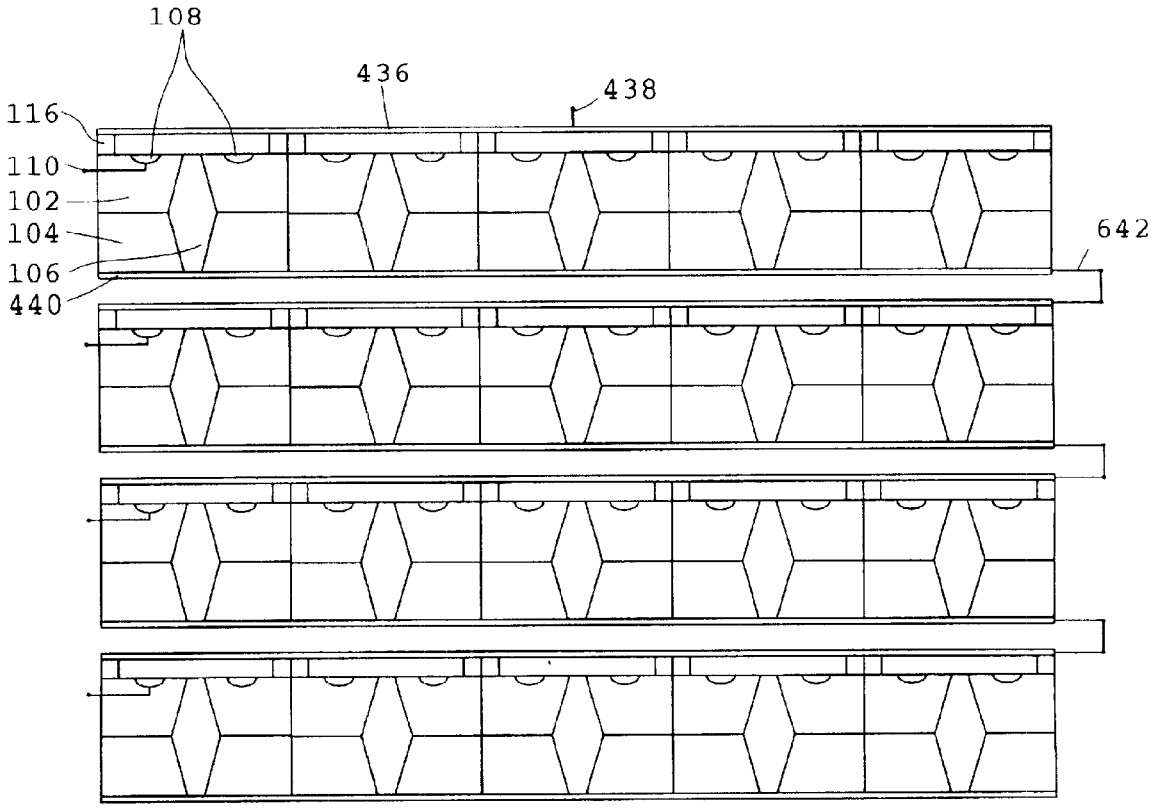
FIG. 6 is a front cross-sectional view of stacked array of microelectromechanical relays in the "off" position.
Figure 7:
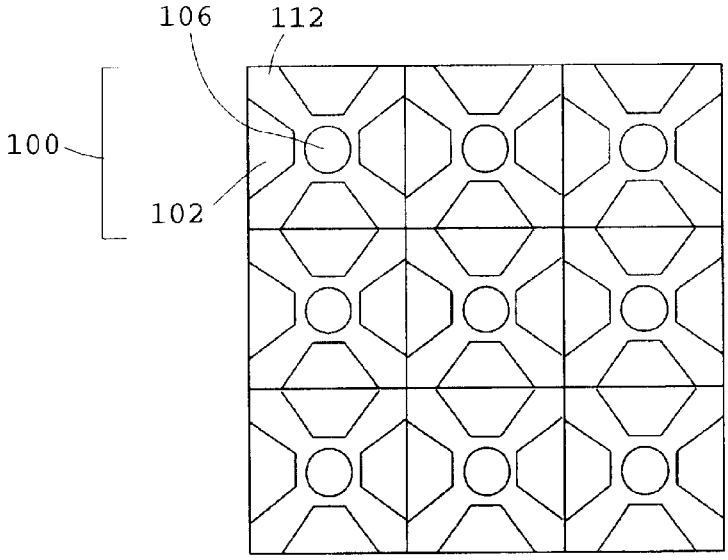
FIG. 7 is a top view of an alternative 3-dimensional array of microelectromechanical relays.

The single cell micro-relay 100 disclosed in FIGS. 1, 2 and 3, or in the alternative embodiment of FIG. 4, can be easily extended to a relay array through massive parallel circuit interconnection of single cells, for example as shown in FIGS. 5, 6 and 7. Stacked array configurations can be used for high power applications, where the voltage is distributed across the array, and where each single relay would not see a significant increase in voltage. These arrays comprise a plurality of single cell microelectromechanical relays 100, and can be arranged in a variety of configurations.

FIG. 5 shows a side-by-side linear configuration of the single cell microelectromechanical relays. When arranged in this manner, the system is capable of switching currents on the order of 1 ampere per device. This array comprises a single upper contact 436 (interconnecting a plurality of upper contacts 112) with a single upper contact source 438, and a single lower contact 440 (interconnecting a plurality of lower contacts 120) and lower contact source 442. The on-resistance of such a parallel configuration with N cells is simply $R_{tot}=R_c/N$ where $R_c$ is the resistance of one single vertical conduction path (one cell), based on the simplifying assumption that each micro-relay 100 cell in this array has substantially the same resistance as all others. If the resistances are made to vary, then these power relays 100 can be used in more complex circuit configurations requiring multiple resistors of multiple resistances.

Additionally, while FIG. 5 shows a parallel circuit, it is possible also to use multiple micro-relays 100 in electrical series with one another as well, and in mixed series/parallel combinations. Thus, these devices, which are most generally characterized as liquid electrical wires with predetermined resistances that can be varied depending on the fabrication of each individual device, each with or without switching/relay capability as desired, can be used as the basic resistive/switching elements in a very wide range of electronic circuits.

For example, multiple micro-relays 100 can be arranged in a 2-dimensional and 3-dimensional array as shown in FIGS. 6 and 7. The vertical stacking of the micro-relays 100 demonstrated in FIG. 6 requires the additional vertical contact 642 between lower contact 440 and upper contact 436 of vertically adjacent rows, and established a series circuit from one row to the next. FIG. 7 shows the top view of a 3-dimensional expansion of the horizontally and vertically stacked arrays. All of these array configurations can be used to increase the power (or current handling) of the power relay system since the current would be distributed across multiple relays at once and each individual relay cell would not necessarily increase its current throughput.

By restricting the flow to small current densities in single micro-relays 100 of any array configuration, the on-resistance can be made arbitrarily small, thus allowing high current operation. Because of the high conductivity of the mercury in the microcavities 106, minimal Joule heating is anticipated. Each single micro-relay 100 carries a very small current.

It is to be observed that while the embodiments illustrated herein illustrate control electrode 108 drawing upper contact 112 toward control electrode 108 and into contact with the liquid metal at the upper end of microcavity chamber 106, that it is possible more generally to eliminate control electrode 108 (or the use thereof) and simply maintain upper contact 112 directly in permanent contact with the liquid metal at the upper end of microcavity chamber 106 at all times, for example, as would be illustrated by FIG. 1 without control electrode 108, and with the contact between upper contact 112 and the liquid metal being regarded as a permanent, fixed connection. In this way, the liquid metal is used simply as a current carrying "liquid wire" independently of the "on" and "off" switching/relay capability that is added by virtue of adding control electrode 108 and using control electrode 108 to draw upper contact 112 into its contact with the liquid metal, and to break this contact, as desired.

Finally, with upper contact 112 continuously moving in and out of contact with the liquid metal in microcavity chamber 106, one might suppose that over time this would deplete the supply of liquid metal by removing miniscule amounts of the liquid metal each time a contact is made and then broken. While this is perhaps a theoretical concern, it is the mechanical motion of upper contact 112 which would likely establish the lifetime of the overall system, and such depletion likely would not happen within the lifetime of the upper contact. However, a solution to this problem, if encountered, is to incorporate a liquid metal, e.g., mercury reservoir, thereby enabling the system to maintain the proper level.

While only certain preferred features of the invention have been illustrated and described, many modifications, changes and substitutions will occur to those skilled in the art. It is, therefore, to be understood that this disclosure and its associated claims are intended to cover all such modifications and changes as fall within the true spirit of the invention.

We claim:

1. A microelectromechanical current carrying system comprising at least one microelectromechanical current carrying apparatus, said at least one microelectromechanical current carrying apparatus comprising:

a microcavity chamber; and a liquid metal filling said microcavity chamber; wherein a voltage differential is applied between said liquid metal at a lower end of said microcavity chamber and said liquid metal at an upper end of said microcavity chamber, thereby causing a current to be carried by said liquid metal.

2. The system of claim 1, said at least one microelectromechanical current carrying apparatus further comprising:

a lower contact contacting said liquid metal at said lower end of said microcavity chamber; and an upper contact contacting said liquid metal at said upper end of said microcavity chamber; wherein said voltage differential is applied to the lower and upper ends of said liquid metal using said lower and upper contacts, thereby causing said current carried by said liquid metal to be carried between said lower contact and said upper contact.

3. The system of claim 2, said at least one microelectromechanical current carrying apparatus further functioning as a relay, wherein:

said upper contact is moved to establish said contact with said liquid metal at said upper end of said microcavity chamber, thereby initiating the carriage of said current between said lower contact and said upper contact; and said upper contact is further moved to break said contact of said upper contact with said liquid metal at said upper end of said microcavity chamber, thereby terminating said carriage of said current between said lower contact and said upper contact.

4. The system of claim 3, said at least one microelectromechanical current carrying apparatus further comprising a control electrode, wherein:

without any force being applied thereto, said upper contact resides in a default position wherein it is not in contact with said liquid metal at said upper end of said microcavity chamber;

said upper contact is moved to establish said contact with said liquid metal and initiate the current carriage by activation of said control electrode to draw said upper contact away from said default position, toward said control electrode, and into said contact with said liquid metal; and said upper contact is moved to break said contact with said liquid metal and terminate the current carriage by deactivation of said control electrode to cease drawing said upper contact toward said control electrode, break said contact of said upper contact with said liquid metal, and allow said upper contact to return to said default position.

5. The system of claim 1, wherein said liquid metal comprises mercury.

6. The system of claim 1, wherein at least part of a side wall of said microcavity chamber is lined with a deposition metal with a high affinity for said liquid metal, thereby enabling chemical vapor deposition of said liquid metal into said microcavity chamber.

7. The system of claim 6, wherein said deposition metal comprises gold.

8. The system of claim 2, said at least one microelectromechanical current carrying apparatus comprising a plurality of microelectromechanical current carrying apparatuses, further comprising:

a common upper contact comprising the upper contacts of at least one of said microelectromechanical current carrying apparatuses being electrically interconnected to the upper contacts of another of least one of said microelectromechanical current carrying apparatuses; and a common lower contact comprising the lower contacts of at least one of said microelectromechanical current carrying apparatuses being electrically interconnected to the lower contacts of another of least one of said microelectromechanical current carrying apparatuses;

said system thereby forming a parallel circuit of said plurality of microelectromechanical current carrying apparatuses so interconnected.

9. The system of claim 8, wherein said plurality of microelectromechanical current carrying apparatuses so interconnected are configured linearly.

10. The system of claim 8, wherein said plurality of microelectromechanical current carrying apparatuses so interconnected are configured in 2-dimensional array.

11. The system of claim 2, said at least one microelectromechanical current carrying apparatus comprising a plurality of microelectromechanical current carrying apparatuses, wherein:

the upper contact of at least one of said microelectromechanical current carrying apparatuses is electrically interconnected to the lower contact of another one of said microelectromechanical current carrying apparatuses;

said system thereby forming a series circuit of said plurality of microelectromechanical current carrying apparatuses so interconnected.

12. The system of claim 4, wherein:

said a control electrode comprises a secondary electrode; and said upper contact comprises an actuation structure.

13. The system of claim 6, wherein substantially all of said side wall of said microcavity chamber is lined with said deposition metal with said high affinity for said liquid metal.

14. The system of claim 13, wherein said deposition metal comprises gold.

* * * * *